US010023380B2

(12) United States Patent
Holdstock et al.

(10) Patent No.: US 10,023,380 B2
(45) **Date of Patent: *Jul. 17, 2018**

(54) FLEXIBLE INTERMEDIATE BULK CONTAINER WITH INDUCTION CONTROL

(71) Applicant: Texene LLC, Summerville, SC (US)

(72) Inventors: Paul Holdstock, Manchester (GB); Carlos Echeverria, Pembroke Pines, FL (US)

(73) Assignee: Texene LLC, Miami Lakes, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/784,958

(22) Filed: Oct. 16, 2017

(65) Prior Publication Data

US 2018/0037405 A1 Feb. 8, 2018

Related U.S. Application Data

(63) Continuation of application No. 15/440,243, filed on Feb. 23, 2017, now Pat. No. 9,815,619, which is a (Continued)

(51) Int. Cl.
*B65D 88/16* (2006.01)
*D03D 1/04* (2006.01)

(Continued)

(52) U.S. Cl.
CPC ..... *B65D 88/165* (2013.01); *B65D 29/00* (2013.01); *B65D 90/46* (2013.01); *D03D 1/04* (2013.01);

(Continued)

(58) Field of Classification Search
CPC ..... B65D 88/165; B65D 29/00; B65D 90/46; D03D 1/04; D03D 15/0005; D03D 15/0088; D06M 13/10; D06M 15/59; D06M 13/207; D06M 13/419; D06M 13/2243; D10B 2321/022; Y10T 442/339; Y10T 442/2418
See application file for complete search history.

(56) References Cited

U.S. PATENT DOCUMENTS 3,335,022 A 8/1967 Sincock
3,849,242 A 11/1974 Takeya et al.

(Continued)

FOREIGN PATENT DOCUMENTS

CA 1 143 673 3/1983
CN 2918277 Y 7/2007

(Continued)

OTHER PUBLICATIONS

DuPont Material Safety Sheet, Entira as 500 Resin, pp. 1-7, Aug. 12, 2011.

(Continued)

*Primary Examiner* — Michael C Miggins
(74) *Attorney, Agent, or Firm* — Blank Rome LLP

(57) ABSTRACT

A method, apparatus and system is provided for both (1) decreasing electrostatic discharges to reduce the potential for incendiary discharges caused by electrostatic charges in flexible containers such as flexible intermediate bulk containers (FIBCs) and (2) decreasing the induction on isolated conductors nearby the container to reduce the potential for incendiary discharges from the isolated conductors.

44 Claims, 2 Drawing Sheets

Related U.S. Application Data continuation of application No. 14/208,566, filed on Mar. 13, 2014, now Pat. No. 9,611,091.

(60) Provisional application No. 61/786,691, filed on Mar. 15, 2013.

(51) Int. Cl.

| | |
|---|---|
| ***D03D 15/00*** | (2006.01) |
| ***B65D 30/00*** | (2006.01) |
| ***D06M 13/10*** | (2006.01) |
| ***D06M 15/59*** | (2006.01) |
| ***D06M 13/207*** | (2006.01) |
| ***D06M 13/419*** | (2006.01) |
| ***D06M 13/224*** | (2006.01) |
| ***B65D 90/46*** | (2006.01) |

(52) U.S. Cl.

CPC ..... *D03D 15/0005* (2013.01); *D03D 15/0088* (2013.01); *D06M 13/10* (2013.01); *D06M 13/207* (2013.01); *D06M 13/2243* (2013.01); *D06M 13/419* (2013.01); *D06M 15/59* (2013.01); *D10B 2321/022* (2013.01); *Y10T 442/2418* (2015.04); *Y10T 442/339* (2015.04)

(56) References Cited

U.S. PATENT DOCUMENTS

| | | | |
|---|---|---|---|
| 4,207,376 | A | 6/1980 | Nagayasu et al. |
| 4,431,316 | A | 2/1984 | Massey |
| 4,833,008 | A | 5/1989 | Derby |
| 4,833,088 | A | 5/1989 | DeSimone et al. |
| 4,900,495 | A | 2/1990 | Lin |
| 4,989,995 | A | 2/1991 | Rubenstein et al. |
| 4,997,712 | A | 3/1991 | Lin |
| 5,071,699 | A | 12/1991 | Pappas et al. |
| 5,092,683 | A | 3/1992 | Wurr |
| 5,116,681 | A | 5/1992 | Lin |
| 5,147,704 | A | 9/1992 | Lin |
| 5,151,321 | A | 9/1992 | Reeves et al. |
| 5,478,154 | A | 12/1995 | Pappas et al. |
| 5,679,449 | A | 10/1997 | Ebadat et al. |
| 5,756,567 | A | 5/1998 | Rohrmann |
| 5,759,462 | A | 6/1998 | Jordan |
| 6,112,772 | A | 9/2000 | Ebadat et al. |
| 6,572,942 | B2 | 6/2003 | Wurr et al. |
| 6,675,838 | B2 | 1/2004 | Arthurs et al. |
| 6,974,783 | B2 | 12/2005 | Akdogan et al. |
| 7,115,311 | B2 | 10/2006 | Arthurs et al. |
| 7,544,742 | B2 | 6/2009 | Walsh |
| 2005/0094903 | A1 | 5/2005 | Nyambi |
| 2006/0269711 | A1 | 11/2006 | Chandra et al. |
| 2008/0269366 | A1 | 10/2008 | Shaffer |

FOREIGN PATENT DOCUMENTS

| | | | |
|---|---|---|---|
| DE | 199 30 093 | A1 | 1/2001 |
| DE | 102 53 836 | A1 | 5/2004 |
| WO | WO-2010/087726 | A1 | 8/2010 |

OTHER PUBLICATIONS

PCC Chemax, Inc. Material Safety Data Sheet, Chemstat LD-100/60DC, pp. 1-7, Feb. 21, 2006.

DOW Material Safety Data Sheet, Engage 8180 Polyolefin Elastomer, pp. 1-8, Sep. 25, 2013.

FLEXIBLE INTERMEDIATE BULK CONTAINER WITH INDUCTION CONTROL

CROSS-REFERENCE TO RELATED APPLICATIONS

This application is a continuation of U.S. patent application Ser. No. 15/440,243 filed Feb. 23, 2017, which is a continuation of U.S. patent application Ser. No. 14/208,566 filed Mar. 13, 2014, now U.S. Pat. No. 9,611,091, which claims priority under 35 U.S.C. § 119(e) to provisional U.S. patent application 61/786,691 filed on Mar. 15, 2013, which are hereby incorporated by reference in their entireties.

BACKGROUND

The disclosure generally relates to antistatic fabrics, and more particularly relates to a system and method for both (1) decreasing electrostatic discharges to reduce the potential for incendiary discharges caused by electrostatic charges in flexible containers such as flexible intermediate bulk containers (FIBCs) and (2) decreasing the induction on any conductors, which may have accidently become isolated, nearby the container to reduce the potential for incendiary discharges from the isolated conductors.

Containers formed of flexible fabric are being used in commerce more and more widely to carry free-flowable materials in bulk quantities. Flexible intermediate bulk containers have been utilized for a number of years to transport and deliver finely divided solids such as cement, fertilizers, salt, sugar, and barite, among others. Such bulk containers can in fact be utilized for transporting almost any type of free-flowable finely divided solid. The fabric from which they are generally constructed is a weave of a polyolefin, e.g., polypropylene, which may optionally receive a coating of a similar polyolefin on one or both sides of the fabric. If such a coating is applied, the fabric will be non-porous, while fabric without such coating will be porous. The usual configuration of such flexible bulk containers involves a rectilinear or cylindrical body having a wall, base, cover, and a closable spout secured to extend from the base or the top or both.

Such containers are handled by placing the forks of a forklift hoist through loops attached to the container. The weight of such a bulk container when loaded is typically between 500 pounds and 4,000 pounds, depending upon the density of the material being transported.

Crystalline (isotactic) polypropylene is a particularly useful material from which to fabricate monofilament, multifilament or flat tape yarns for use in the construction of such woven fabrics. In weaving fabrics of polypropylene, it is the practice to orient the yarns monoaxially, which may be of rectangular or circular cross-section. This is usually accomplished by hot-drawing, so as to irreversibly stretch the yarns and thereby orient their molecular structure. Fabrics of this construction are exceptionally strong and stable as well as being light-weight.

Examples of textile fabrics of the type described above and flexible bulk containers made using such fabrics are disclosed in U.S. Pat. Nos. 3,470,928, 4,207,937, 4,362,199, and 4,643,119.

It has been found that the shifting of specific materials within containers made of woven fabrics, as well as particle separation between the materials and such containers during loading and unloading of the container cause triboelectrification and create an accumulation of static electricity on the container walls. In addition, the accumulation of static electricity is greater at lower relative humidity and increases as the relative humidity drops. Also, highly charged material entering such containers can create an accumulation of static electricity on the container walls. Electrostatic discharges from a charged container can be incendiary, i.e., cause combustion in dusty atmospheres or in flammable vapor atmospheres. Moreover, discharges can be quite uncomfortable to workers handling such containers. Furthermore, the buildup of electrostatic charge on such containers may cause such containers to become a source for induction to isolated conductors. The primary means of preventing incendiary electrostatic discharges from conductors is to ensure conductors in hazardous areas are properly and securely grounded. However, there may be occasions when, by accident, ground connections are less than ideal, or missing completely. Examples of such occasions include: when the soles of a person's conductive boots become covered in dirt or other electrically insulating contaminants; steel drums being placed on plastic pallets or on wooden pallets covered in plastic sheets, or on wooden pallets when the ambient humidity is very low; and metal hand tools being left on insulating surfaces.

One conventional approach to solving this problem is to use a grounded container. Such a container may include conductive fibers that are electrically connected to ground to carry the electric charge from the surface of the bag. The conductive yarns may be interconnected and one or more connection points may be provided for an external ground source. For example, Canadian Patent 1,143,673 and U.S. Pat. No. 4,431,316 disclose a fabric construction based on polyolefin yarn having conductive fibers in the yarns. Alternatively, the fabric may be coated with a layer of plastic film having an outer metalized surface, such as disclosed in U.S. Pat. No. 4,833,008.

The use of a grounded container, however, works only as long as the container remains grounded. If the container becomes ungrounded, its ability to decrease the potential for an incendiary discharge is lost, and due to the higher capacitance of the conductive system, the discharge can be much more energetic and incendiary than conventional non-conductive containers. Specifically, if such a container is not grounded, a spark discharge may develop which is capable of igniting flammable vapors or dust clouds and therefore must be grounded during the fill and emptying operations to provide a path for electrical discharge. Additionally, fabrication of the conductive containers requires specialized construction techniques to ensure all conductive surfaces are electrically connected together for a ground source.

Another conventional approach to decreasing the potential for incendiary discharges in flexible containers has been directed toward decreasing the surface electrostatic field of the container. If the magnitude of the electrostatic field on the surface of a container is above a certain threshold level, the potential for an incendiary discharge due to the electrostatic charge exists. That threshold level is about 500 kilovolts per meter (kV/m) for intermediate bulk containers made from woven polypropylene fabric. By decreasing the surface electrostatic field below about 500 kV/m, the potential for an incendiary discharge is greatly decreased and believed to be rendered virtually non-existent. Attempts at reducing the surface electrostatic field level below about 500 kV/m have not, however, proven successful without proper grounding.

One such effort at decreasing surface electrostatic fields has focused on the creation of corona discharges. There are four basic types of electrostatic discharges: spark discharges; brush discharges; propagating brush discharges; and, corona discharges. Of the four electrostatic discharges, the spark, the brush and the propagating brush electrostatic discharges can all create incendiary discharges. The corona discharge is not known to create incendiary discharges for common flammable atmospheres.

By incorporating certain materials into the flexible fabric container, as the electrostatic field increases, corona discharges from such materials limit the maximum field. This electrostatic field level, however, is above the 500 kV/m threshold level at which the potential for incendiary discharge first appears. Examples of this conventional approach include U.S. Pat. No. 4,207,376 (Nagayasu), U.S. Pat. No. 4,989,995 (Rubenstein), U.S. Pat. No. 4,900,495 (Lin), U.S. Pat. No. 4,997,712 (Lin), U.S. Pat. No. 5,116,681 (Lin) and U.S. Pat. No. 5,147,704 (Lin).

Another approach to the problem of incendiary discharge has been to decrease the surface resistivity of a container by coating the container with an antistatic material. Such a coating on the container surface increases the threshold level of the potential for an incendiary discharge to about 1500 kV/m. However, the potential for an incendiary discharge is still a very real possibility. Examples of this approach include U.S. Pat. No. 5,151,321 (Reeves) and U.S. Pat. No. 5,092,683 (Wurr).

Still another approach to the problem of incendiary discharge is an ungrounded flexible container having the sides, top, bottom and loops formed of a quasi-conductive material. This approach is described in detail in U.S. Pat. Nos. 5,478,154; 5,679,449; and 6,112,772 the entire disclosures of which are incorporated herein by reference.

Although ungrounded flexible containers have been successful at addressing the problem of incendiary discharges from the container, some believe that with conventional ungrounded flexible containers, the charge dissipation from the flexible containers generally is not complete, and a residual charge remains on the flexible containers that can charge an accidentally ungrounded object or person nearby the flexible container through induction, and that charge induced to an ungrounded object or person potentially could produce an incendiary discharge, which in turn may ignite flammable gases and/or solvent vapors in the atmosphere.

BRIEF DESCRIPTION OF THE DRAWINGS

A fuller understanding of the invention may be had by referring to the following description and claims taken in conjunction with the accompanying drawings, wherein:

DETAILED DESCRIPTION

Figure 1:
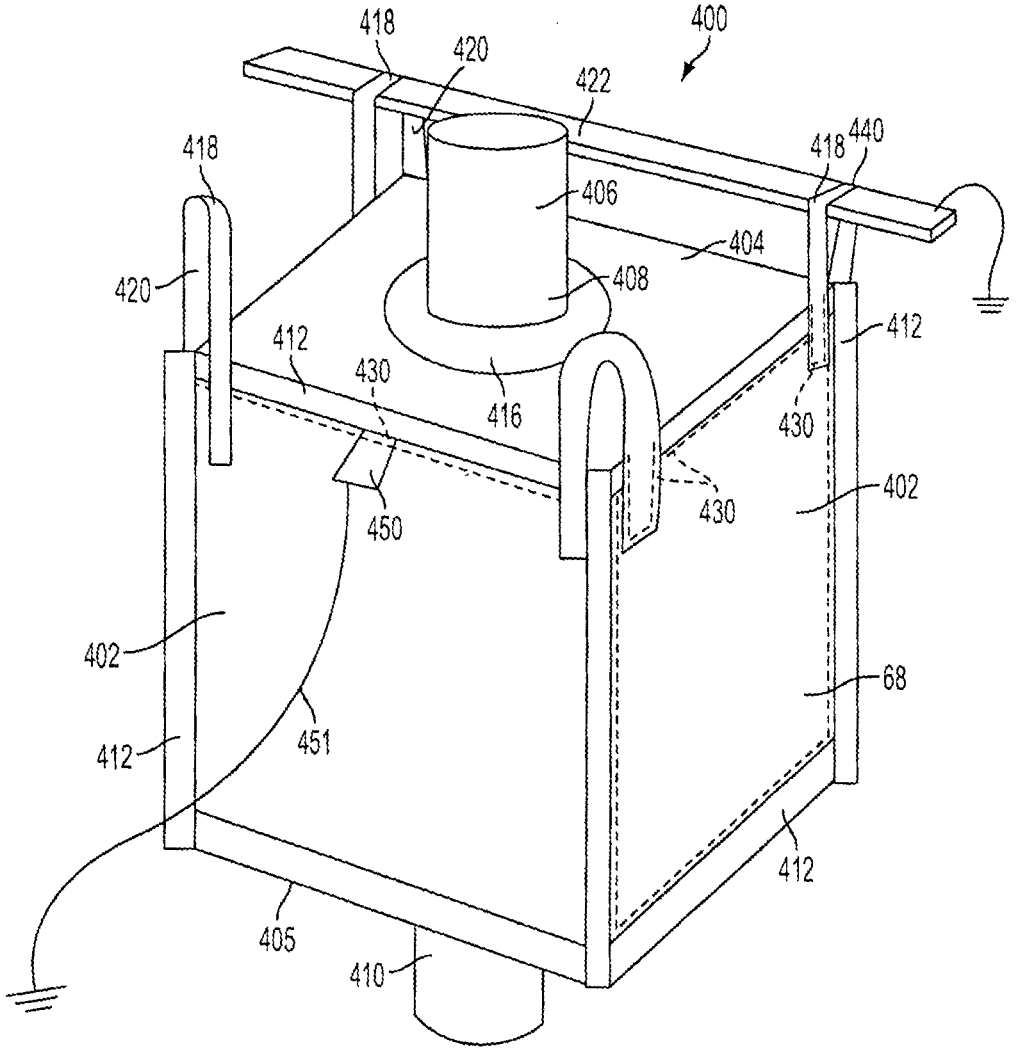
FIG. 1 is a perspective view of a flexible container constructed in accordance with a preferred embodiment.

The general purpose of the embodiments disclosed herein is to provide users of normally ungrounded static protective flexible intermediate bulk containers (FIBC), otherwise known as Type D FIBC, with a means of reducing the risk of hazardous induced voltages on nearby ungrounded conductors, including personnel and equipment, by reducing the residual charge, and the associated electric field, on the FIBC and its contents. Such static protective Type D FIBCs according to the disclosed embodiment are constructed from woven fabric panels including quasi-conductive fibers and in which the base fabric and/or the polymeric film coating including an antistatic (or static dissipative) additive, and sewn together with yarns including quasi-conductive fibers, conductive fibers, or standard sewing yarn.

The use of quasi-conductive fibers in the woven fabric reduces the propensity for the fabric to produce incendiary discharges when it is isolated from ground (i.e. ungrounded). The use of an antistatic (or static dissipative) additive in the coating enables the FIBC to be grounded thereby reducing residual charge. The electrical continuity between the coated sides of the fabric panels can be enhanced by the use of quasi-conductive or conductive fibers in the yarns used to sew the panels together, and by FIBC construction techniques, including the positioning of folded edges either inside or outside the FIBC or the use of unhemmed fabric, and the style of sewing stitch. Grounding of the FIBC is achieved either by connection of a ground cable to at least one of the one or more grounding tags sewn into the seams of FIBC, or directly to a seam.

Quasi-conductive fibers are twisted with carrier fibers to produce an embodiment of quasi-conductive fibers/yarns that are included in the warp and/or weft of the woven fabric. Quasi-conductive fibers are so called because the resistance of the fibers, measured by conventional means, is outside of what is conventionally regarded as the conductive range, but the fibers do dissipate electrostatic charge and in that sense appear to behave in the same way as conductive fibers. The principal mechanism by which quasi-conductive fibers dissipate charge is by low-energy corona discharge. For effective use in ungrounded static protective FIBC, the resistance of quasi-conductive fibers is sufficiently low to allow corona to occur, but not so low that incendiary spark discharges occur.

Corona occurs when the localized electric field exceeds the breakdown value of the atmosphere, which for air is about 3 MV/m. As charge is dissipated by corona, the localized electric field weakens until at some point corona no longer occurs. Once corona has ceased, there will be some residual charge on the FIBC. The amount of residual charge is too small to produce an incendiary discharge directly from the FIBC, but it may induce hazardous voltages on nearby isolated conductors, including personnel and equipment such as tools, and other objects. Safe practice guidelines as described in National and International Standards and Codes of Practice require that all conductors, including personnel and equipment, be properly grounded when flammable or combustible atmospheres are present. However, in practice, personnel, or small hand tools, may not always be properly grounded. It is, therefore, desirable to reduce the risk of such personnel and equipment becoming charged by induction from residual charge on FIBC. The use of an antistatic (or static dissipative) additive in the base fabric and/or coating, combined with the use of quasi-conductive or conductive fibers in the sewing yarns and/or other constructional techniques to improve the electrical continuity between panels in a static protective FIBC, allows a controlled degree of conduction to take place when the FIBC is grounded. This conduction mechanism reduces residual charge and thereby reduces induced voltages on any nearby ungrounded conductors.

For purposes of this disclosure, the following terms have the indicated definitions. "Quasi-conductive fibers" means fibers composed of filaments that are sized and shaped to effect corona discharges at corona discharge points while having a resistance to avoid electrostatic discharges at the ends and along the length of the filaments at a rate that would result in an incendiary type of discharge in a combustible environment. A typical FIBC industry parameter for a combustible environment (including, for example, flammable vapor atmospheres, combustible atmospheres, dusty atmospheres, and explosive atmospheres) is minimum ignition energy (MIE) of 0.25 millijoules (mJ). Another MIE in use is 0.14 mJ. "Controlled-conductive" with respect to a container or other object means that (1) when the container or object is not grounded, it has sufficient charge dissipation such that the residual charge is maintained below that required to cause an incendiary discharge in a combustible environment when the container or other object is being emptied or filled with highly charged products; and (2) when the container or object is grounded, it has sufficient charge dissipation such that the residual charge is maintained below that required to cause potentials sufficient to cause an incendiary discharge in a combustible environment to be induced on nearby isolated conductors when the container or other object is being emptied or filled with highly charged products. One way to determine if a container or other object meets (1) above is if it is able to pass the IEC 61340-4-4, second edition, Ignition Test. One way to determine if a container or other object meets (2) above is the Drum Test, which is described in more detail herein.

Embodiments described herein provide controlled-conductive flexible containers. Flexible containers each include one or more sides, a top attached to the sides, a bottom attached to the sides, and a plurality of loops extending from the container. The sides, top, bottom and loops are formed of woven fabric panels including quasi-conductive fibers. In an alternate embodiment, quasi-conductive fibers may not be included in the loops. The woven fabric may be coated with a polymeric film and the woven fabric and/or the polymeric film coating include an antistatic (or static dissipative) additive. In addition, the sides, top, bottom and loops can be secured or sewn together using yarns including quasi-conductive fibers, or conductive fibers, or standard sewing yarn. Further, the container includes at least one grounding tag. In one embodiment, the preferred construction for grounding tags is woven fabric including quasi-conductive fibers and an antistatic (or static dissipative) additive in the coating. In one embodiment, the grounding tag is at least one of the loops.

Embodiments also provide a container filling system including a controlled-conductive flexible container. The system includes a flexible container adapted to inhibit incendiary discharges from the container and to reduce the residual charge on the container, thereby reducing the risk of induced voltages on an ungrounded conductive object or person positioned a distance from the surface of the container.

The system includes the flexible container and a hoisting apparatus. The flexible container has one or more sides, a top attached to the sides, a bottom attached to the sides, and a plurality of loops extending from the container. The sides, top, bottom and loops are formed of woven fabric panels including quasi-conductive fibers. The woven fabric may be coated with a polymeric film and the woven fabric and/or the polymeric film coating include an antistatic (or static dissipative) additive. In addition, the sides, top, bottom and loops can be secured or sewn together using yarns including quasi-conductive fibers, or conductive fibers, or standard sewing yarn. Further, the container includes at least one grounding tag. The hoisting apparatus is adapted to hold the flexible container by one or more of the loops. In one embodiment, the grounding tag is at least one of the loops.

Referring now to the drawings, where like reference numerals indicate like elements, there is shown in FIG. 1 an ungrounded flexible intermediate bulk container 400 constructed in accordance with one embodiment. Although a rectilinear container 400 is shown, it is to be understood that the shape of the container could be any other suitable shape, such as cylindrical, conical or frusticonical.

The container 400 is constructed of sections of woven fabric 68 including quasi-conductive fibers 62, which are described in more detail below in connection with FIG. 3. The fabric 68 sections are utilized to make up walls 402, a top 404 and a bottom 405 of the container 400.

The walls 402, top 404, bottom 405 and loops 418 are attached to one another to construct the container 400. In the FIG. 1 embodiment, the walls 402, top 404, bottom 405 and loops 418 are sewn together with stitching 430, but other known means for attaching the components can be used. In the FIG. 1 embodiment, one row of stitching 430 is used, but a plurality of rows of stitching 430 may also be used. The container 400 can be made according to various known construction techniques, including the positioning of folded edges either inside or outside the container 400 or the use of unhemmed fabric, and the style of sewing stitch 430. The stitching 430 is done with yarns preferably including quasi-conductive fibers 62 (which are described in more detail in U.S. Pat. Nos. 5,478,154; 5,679,449; and 6,112,772), but may also include yarns having conductive fibers or standard sewing yarn, or a combination of any of these three fibers. Yarns including quasi-conductive fibers 62 or conductive fibers and be fabricated by twisting or otherwise intermingling quasi-conductive fibers 62 or conductive fibers with conventional yarn. Quasi-conductive fibers are available from Texene LLC of Summerville, S.C. (Texene).

Use of the quasi-conductive fibers 62 or conductive fibers can enhance the electrical communication between the components of the container 400 (i.e., the walls 402, top 404, bottom 405 and loops 418).

Optionally, edge webbing 412 is sewn (also with stitching 430) to the edges of each of the walls 402, the top 404 and the bottom 405 to construct the generally rectilinear container 400. The edge webbing 412 can be formed of a different material than the material of the fabric sections 68. In FIG. 1, the edge webbing 412 is formed of a non-conductive material, namely polypropylene or polyester yarns, without the quasi-conductive fibers 62 woven therein. In another embodiment the edge webbing includes quasi-conductive fibers or conductive fibers or a mixture of both. In another embodiment the container 400 does not include edge webbing 412.

The top 404 includes an input spout 406, which is used for filling the container 400. The bottom 405 includes an output spout 410, which is used for emptying the container 400. The input spout 406 is attached to the top 404 by sewing spout webbing 416 to the top 404 and a lower portion 408 of the spout 406. In another embodiment the input spout 406 is sewn directly to the top 404. The output spout 410 may be attached to the bottom 405 by a similar mechanism. Drawstrings (not shown) may be incorporated into the spouts 406, 410 for closing or opening the spouts 406, 410 as needed in filling or emptying procedures.

Since the containers 400 are cumbersome and extremely heavy once filled, it is desirable to have the containers 400 hoisted and held at an elevation. Loops 418 are sewn to the walls 402 (using stitching 430) or otherwise attached to walls 402 and extend above the top 404. As shown in FIG.

1, each end of a strip is sewn, or otherwise attached, to adjoining walls 402 to create a loop 418 at each corner of the container 400. Each loop 418 is formed to receive a fork 422 of a forklift hoist (not shown). Specifically, a fork 422 is positioned within two loops 418, coming in contact with undersides 420 of the loops 418. Only one fork 422 is shown in FIG. 1, but it is to be understood that two forks 422, or a multiple of other hoisting apparatus, may be used. Further, it is to be understood that the forklift hoist, or other hoisting apparatus, may be a grounded apparatus, such that one or more of the loops serve to ground the container 400 when in contact with the forks 422 of the forklift or relevant portion of another apparatus.

In the embodiment of FIG. 1, the spout webbing 416 and the loops 418 preferably are formed of woven polypropylene tapes.

The container 400 also includes a grounding tag 450, which is sewn (using stitching 430) or otherwise attached to the container 400. The grounding tag 450 is configured to be connected to ground by a connection 451. The connection 451 can be any suitable conductive connection that provides an electrical connection between the grounding tag 450 and a ground potential. In FIG. 1, one grounding tag 450 is shown between the top 404 and a wall 402, but the grounding tag 450 could be place in any location that would permit the grounding tag 450 to be connected to ground and a plurality of grounding tags 450 can be included. Alternatively, the grounding tag 450 can be omitted and the container 400 can be grounded by attaching the connection 451, such as a ground cable, directly to a portion of the stitching 430, or to an area of any of the edge seams.

Figure 2:
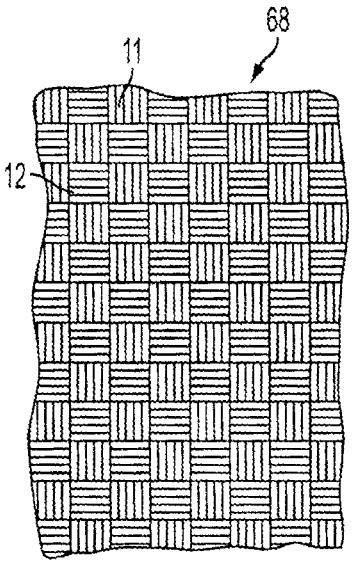
FIG. 2 is a schematic of the fabric used in constructing the flexible container of FIG. 1.

FIG. 2 depicts a section of woven fabric 68 including vertically extending warp fibers 11 interwoven with horizontally extending weft or filling fibers 12. These fibers 11, 12 are interwoven by techniques well known in the art on a textile loom to form a sheet-like material relatively free of interstices. The tightness of the weave depends on the end use. Where the fabric 68 is to be used to form containers for holding large particle size bulk material such as flakes or pellets, then a fairly open weave of mono or multifilament fiber may be used in a count range of from about 1000 to 3000 denier in each weave direction. The fabric 68 may also be coated on one or both sides. The coating (42, 43) is described in more detail in connection with FIG. 4.

Figure 3:
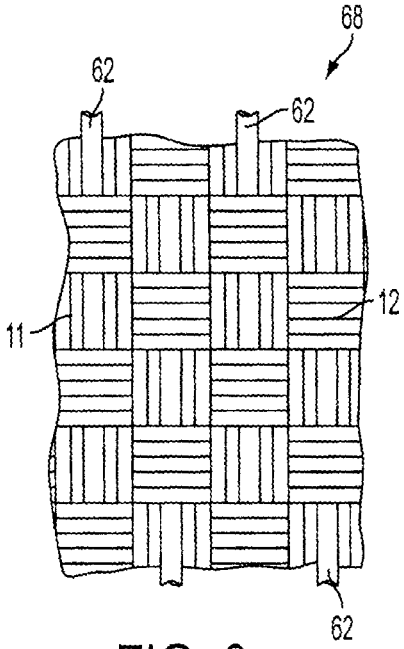
FIG. 3 is a partial view of a woven fabric section including quasi-conductive fibers woven in the warp direction.
Figure 4:
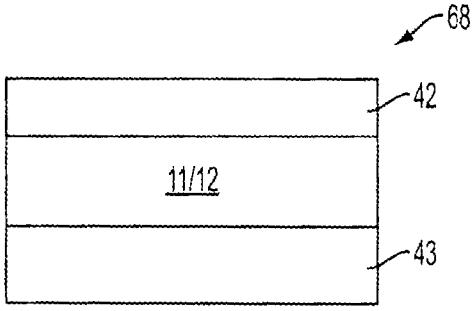
FIG. 4 is a schematic of the fabric of FIG. 2 including coatings.

FIG. 3 depicts fabric 68 including quasi-conductive fibers 62 oriented alongside the warp fibers 11. Alternatively, the weft fibers 12 can include the quasi-conductive fibers 62 or both the warp fibers 11 and weft fibers 12 can include quasi-conductive fibers 62. Furthermore, while the fibers 11, 12 are shown in FIGS. 2 and 4 in a standard over one-under one pattern, the fibers 11, 12 can be woven in any pattern or otherwise included within fabric section 68 in any manner, provided the properties of the container 400 (FIG. 1) are maintained.

The fabric warp and weft fibers 11 and 12 may be composed of any suitable material. In one example the fibers 11 and 12 are a tight weave of axially oriented polypropylene flat tape material having a preferred thickness of from about 0.5 to about 2 mils and a preferred width of from about 50 to about 250 mils. It will be appreciated that by use of the flat tape fibers, maximum coverage is obtained with the least amount of weaving since it requires relatively few flat fibers per inch to cover a given surface as compared to fibers of circular cross section. The flat fibers may be woven single, double, folded or fibrillated. It is important that the ribbon-like fibers be highly oriented monoaxially in the longitudinal direction or biaxially in the longitudinal and transverse directions. This is accomplished by so drawing the flat fiber or the web from which flat fiber ribbons are slit, so as to irreversibly stretch the fiber or web, thereby orienting the molecular structure of the material. In biaxially oriented fibers or sheeting, the material is hot or cold-stretched both in the transverse and longitudinal directions, or instead may be carried out mainly in the longitudinal direction or mainly in the transverse direction.

When axially oriented polypropylene fibers are interwoven, they cross over in the warp and weft directions, and because of their high tear and tensile strength, as well as their hydrophilic properties, the resultant fabric is highly stable. Thus the bag, if properly seamed, is capable of supporting unusually heavy loads without sagging or stretching of the walls of the bag.

The fabric warp and weft fibers 11 and 12 may also include an antistatic or static dissipative material as an additive. Antistatic materials cause the threshold level for the potential for an incendiary charge to be increased. Any suitable additive having antistatic or static dissipative properties can be used. Preferred examples include glycerol monostearate (referred to herein as GMS), and lauric diethanolamide, commercially available for example under MSDS X40452, (referred to herein as Component X), and high molecular antistatic agents, for example a composition including an electrostatic dissipative blend of about 40 to about 84 weight % of a polyamide polymer, greater than 15 to 59 weight % of a potassium ionomer, and greater than 1 to about 10 weight % of one or more polyol, commercially available for example under MSDS 130000036527, (referred to herein as Component Y). Generally, the greater the amount of additive, the more conductive the material will be. The amount of additive to use for controlled-conductive containers may depend on factors including coating thicknesses, fiber and container geometries and container materials. In the examples described below, 2.4% GMS, 3% to 12.5% Component X, and 2.5% to 5% Component Y was used in controlled-conductive containers.

The quasi-conductive fibers 62 have a resistivity that prevents an incendiary discharge from occurring from the fiber surface. The electric charge instead travels down the length of the quasi-conductive fiber 62 and exits the quasi-conductive fibers 62 as a corona discharge at discharge points along its length and at its ends. In the event of an electrostatic discharge from the quasi-conductive fibers 62, a significant fraction of the stored energy is used in overcoming the resistance of the quasi-conductive fibers 62, leaving far less energy transferred into the discharge gap. Hence, electrostatic discharges from the quasi-conductive fibers 62 do not transfer sufficient energy to be incendiary. If conductive fibers were to be used instead of quasi-conductive fibers 62, the capacitance of the container 400 (FIG. 1) would be increased and a larger store of energy available for discharge may develop. If a grounded or large conductor approaches the ascribed conductive system, an energetic discharge, transferring a large fraction of the stored energy, may occur at such a level as to be incendiary.

The fabric 68 can include one or both of coatings 42, 43 as shown in FIG. 4. The coatings 42, 43 can be a thermoplastic polymer material adhered to both sides of the fabric 68. Alternatively, only one of the coatings 42, 43 can be included. The coatings 42, 43 may also include an antistatic or static dissipative material as an additive. Antistatic materials cause the threshold level for the potential for an incendiary charge to be increased. Any suitable additive having antistatic or static dissipative properties can be used. Preferred examples include GMS, Component X, and Component Y. Generally, the greater the amount of additive, the more conductive the material will be. The amount of additive to use for controlled-conductive containers may depend on factors including coating thicknesses, fiber and container geometries and container materials. In the examples described below, 2.4% GMS and 3% to 12.5% Component X, and 2.5% and 5% Component Y was used in controlled-conductive containers.

A coating using Component Y is sufficiently durable when used use in a flexible intermediate bulk containers for transporting finely divided solids to last over a number of cycles of use, washing, refurbishing and reuse, while maintaining its structural integrity and antistatic properties.

Compatibilizers may be used to improve the dispersion of antistatic (or static dissipative) additives throughout the coating. The preferred compatibilizer for Component Y is an ethylene-1-octene copolymer, commercially available for example under CAS 26221-73-8 (referred to herein as Component Z) with the ratio of Component Y/Component Z of between 5:1 to 1:2. In the examples described below, the ratio of Component Y/Component Z in the coating was 2.5% Component Y/2% Component Z or 5% Component Y/4% Component Z. Information for obtaining components under MSDS numbers and/or CAS numbers is available, for example, at www.msdsonline.com, at www.chemicalbook.com or at www.cas.org.

The purpose of the thermoplastic coating 42, 43 in FIG. 4 is primarily to seal the interstices of the fiber weave to prevent leakage of any finely divided contents of containers made from the fabric, and also to impart moisture barrier properties to containers or in other fabric applications such as tarpaulin or tent fabrics. The thermoplastic coating may also serve as a dispersing base for an antistatic agent which helps impart antistatic properties to the fabric as more fully discussed below.

The thermoplastic coating may be composed of any thermoplastic polymer composition which is sufficiently non-brittle so that the flexible characteristics of the woven fabric are not seriously diminished and which is adherable to the polypropylene fiber material forming the fabric base.

The thermoplastic coating may be applied to one or both surfaces of the woven fabric by techniques known in the art such as extrusion coating, dip coating, and spray coating. Generally speaking, the coating may be applied to a dry coating thickness within the range of from about 0.5 to about 3.0 mils, preferably from about 0.8 to about 1.5 mils.

Examples

Containers were constructed using CROHMIQ® fabric and quasi-conductive fibers (available from Texene LLC) according to embodiments described herein, and tested. Table 1 provides the details for a number of containers.

TABLE 1

| Container # | Fabric (68) | Coating (42, 43) | Stitching (430) |
|---|---|---|---|
| 1 | QC Warp | Regular | Regular |
| 2 | QC Warp | Regular | Quasi-conductive |
| 3 | QC Warp | Regular | Conductive |
| 4 | QC Warp | 2.4% GMS | Regular |
| 5 | QC Warp | 2.4% GMS | Quasi-conductive |
| 6 | QC Warp | 2.4% GMS | Conductive |
| 6A | QC Warp | 2.4% GMS | Conductive |
| 7 | QC Warp + GMS | Regular | Quasi-conductive |

TABLE 1-continued

| Container # | Fabric (68) | Coating (42, 43) | Stitching (430) |
|---|---|---|---|
| 8 | QC Warp + GMS | Regular | Conductive |
| 9 | QC Warp + GMS | 2.4% GMS | Quasi-conductive |
| 10 | QC Warp + GMS | 2.4% GMS | Conductive |
| 11 | QC Warp | 2.4% GMS | Regular |
| 12 | QC Warp | 2.4% GMS | Regular |
| 13 | QC Warp | 2.4% GMS | Quasi-conductive |
| 14 | QC Warp | 2.4% GMS | Conductive |
| 14A | QC Warp | 2.4% GMS | Conductive |
| 15 | QC Warp + GMS | 2.4% GMS | Regular |
| 16 | QC Warp + GMS | 2.4% GMS | Regular |
| 17 | QC Warp + GMS | 2.4% GMS | Quasi-conductive |
| 18 | QC Warp + GMS | 2.4% GMS | Conductive |
| 19 | QC Warp | 2.4% GMS | Quasi-conductive |
| 20 | QC Warp | 3% Component X | Quasi-conductive |
| 21 | QC Warp | 4% Component X | Quasi-conductive |
| 22 | QC Warp | 6% Component X | Quasi-conductive |
| 23 | QC Warp | 8.5% Component X | Quasi-conductive |
| 24 | QC Warp | 12.5% Component X | Quasi-conductive |
| 25 | QC Warp | 2.5% Component Y/ 2% Component Z | Quasi-conductive (hems folded outside) |
| 26 | QC Warp | 2.5% Component Y/ 2% Component Z | Quasi-conductive (hems folded inside) |
| 27 | QC Warp | 5% Component Y/ 4% Component Z | Quasi-conductive (hems folded outside) |
| 28 | QC Warp | 5% Component Y/ 4% Component Z | Quasi-conductive (hems folded inside) |

In the Fabric column, QC Warp refers to fabric including quasi-conductive fibers 62 that are inserted at regular intervals in the warp direction, and +GMS refers to the Weft fibers 12 being made with the addition of 2.4% glycerol monostearate.

In the Coating column, "Regular" refers to a fabric not coated with an antistatic (or static dissipative) additive, "2.4% GMS" refers to a coating (42, 43) on the inside of the fabric made with the addition of 2.4% glycerol monostearate, and "6% Component X "refers to a coating (42, 43) on the inside of the fabric made with the addition of and 6% Component X. Other containers were tested with a coating (42, 43) on the inside of the fabric made with the addition of Component X with the amount of Component X ranging from 3% to 12.5%. Other containers were tested with a coating (42, 43) on the inside of the fabric made with the addition of Component Y and Component Z. The amount of Component Y added to the coating ranged from 2.5% to 5% and the amount of Component Z ranged from 2% to 4%.

In the stitching column, "Regular" refers to no conductive or quasi-conductive fibers used in the stitching, Quasi-conductive refers to quasi-conductive fibers used in the stitching, and "Conductive" refers to conductive fibers used in the stitching. Quasi-conductive plus hems folded either outside or inside refers to quasi-conductive fibers used in the stitching, wherein the positioning of the folded edges is either inside or outside the container.

Containers, as described in Table 1, were tested according to two methods: (1) the IEC 61340-4-4, second edition, ignition testing, and (2) the Drum Test, each of which is described in more detail below.

Type D flexible intermediate bulk containers (FIBC) are qualified as safe for use in explosive atmospheres without grounding by carrying out ignition testing in accordance with the International Electrotechnical Commission Standard IEC 61340-4-4, second edition, which is incorporated herein by reference. The containers were testing according to this IEC standard, at an MIE of 0.14 mJ. Measurements were taken at both high and low humidity. As defined in the specifications in this IEC standard, low humidity (L) is specified as (23±2)° C. and (20±5)% relative humidity, and high humidity (H) is specified as (23±2)° C. and (60±10)% relative humidity.

Containers, as described in Table 1, were also tested in accordance with the Drum Test, which is designed to determine that there is sufficient charge dissipation within a grounded container in order for the residual charge to be maintained below that required to cause potentials to be induced on nearby isolated conductors when the container under test is being filled with highly charged products, sufficient to cause an incendiary discharge in a combustible environment. The Drum Test was devised by Texene and Swissi Process Safety GmbH (formerly known as, Swiss Institute for the Promotion of Safety & Security) to simulate the industrial situation where a large isolated conductor is positioned close to the container. The Drum Test procedure was conducted as follows:

1. The container under test is positioned on the recirculating container filling rig as specified in IEC 61340-4-4, Ed. 2.0.
2. The container is connected to ground.
3. A 55 gallon steel drum is positioned on an insulating support next to the container under test. The distance between the side of the steel drum and the nearest side of the container when it is full is adjusted to be approximately 10 cm.
4. An electrostatic voltmeter is connected to the steel drum to measure the voltage (or electrical potential) induced on the steel drum.
5. The container is filled with polypropylene pellets, with a charging current of (3.0±0.2) μA, negative polarity as specified in IEC 61340-4-4, Ed. 2.0.
6. The voltage induced on the steel drum is constantly recorded during the container filling operation.
7. As the container is filled, an ignition probe as specified in IEC 61340-4-4, Ed. 2.0 is brought up to the steel drum in a sequence of attempts to provoke an incendiary discharge, at an MIE of 0.14 mJ.
8. Multiple ignition probe approaches are made.
9. The test sequence is repeated with the drum positioned next to each side of the container under test.
10. The Drum Test is passed if the voltage on the steel drum remains below 5 kV and/or no ignitions occur.

The results of the IEC 61340-4-4, $2^{nd}$ Ed., Ignition Testing and Drum Testing of the containers are shown in Table 2 below. Measurements were taken at both high and low humidity. As defined in the IEC 61340-4-4, Ed. 2.0, low humidity (L) is specified as (23±2)° C. and (20±5)% relative humidity, and high humidity (H) is specified as (23±2)° C. and (60±10)% relative humidity. The containers that pass both tests are controlled-conductive containers, i.e., when the container not grounded, it qualifies as a Type D container (is able to pass the IEC 61340-4-4, second edition, Ignition Test), and when grounded, there is sufficient charge dissipation within the container in order for the residual charge to be maintained below that required to cause potentials to be induced on nearby isolated conductors when the container under test is being filled with highly charged products, the potentials being sufficient to cause an incendiary discharge in a combustible atmosphere.

TABLE 2

| Container # | Fabric (68) | Coating (42, 43) | Stitching (430) | IEC 61340-4-4, $2^{nd}$ Ed., Ignition Test | Drum Voltage (kV) | Drum Test |
|---|---|---|---|---|---|---|
| 1 | QC Warp | Regular | Regular | PASS | 4.3 to 9.1 | FAIL |
| 2 | QC Warp | Regular | Quasi-conductive | PASS | 1.1 to 5.0 | FAIL |
| 3 | QC Warp | Regular | Conductive | PASS | 0.6 to 8.6 | FAIL |
| 4 | QC Warp | 2.4% GMS | Regular | PASS | 3.7 to 12.9 | FAIL |
| 5 | QC Warp | 2.4% GMS | Quasi-conductive | PASS | 1.3 to 4.7 | PASS |
| 6 | QC Warp | 2.4% GMS | Conductive | PASS | 0.9 to 5.2 | PASS |
| 6A | QC Warp | 2.4% GMS | Conductive | PASS | 2.3 to 9.9 | FAIL |
| 7 | QC Warp + GMS | Regular | Quasi-conductive | PASS | 1.4 to 7.6 | FAIL |
| 8 | QC Warp + GMS | Regular | Conductive | PASS | 2.3 to 7.0 | FAIL |
| 9 | QC Warp + GMS | 2.4% GMS | Quasi-conductive | PASS | 0.5 to 5.8 | FAIL |
| 10 | QC Warp + GMS | 2.4% GMS | Conductive | PASS | 1.1 to 7.3 | FAIL |
| 11 | QC Warp | 2.4% GMS | Regular | PASS | 2.4 to 14.5 | FAIL |
| 12 | QC Warp | 2.4% GMS | Regular | PASS | 1.3 to 8.3 | FAIL |
| 13 | QC Warp | 2.4% GMS | Quasi-conductive | PASS | 0.1 to 5.8 | PASS |
| 14 | QC Warp | 2.4% GMS | Conductive | PASS | 0.8 to 6.0 | PASS |
| 14A | QC Warp | 2.4% GMS | Conductive | PASS | 0.5 to 9.0 | FAIL |
| 15 | QC Warp + GMS | 2.4% GMS | Regular | PASS | 0.2 to 7.3 | PASS |
| 16 | QC Warp + GMS | 2.4% GMS | Regular | PASS | 2.3 to 9.5 | FAIL |
| 17 | QC Warp + GMS | 2.4% GMS | Quasi-conductive | PASS | 0.6 to 8.1 | PASS |
| 18 | QC Warp + GMS | 2.4% GMS | Conductive | PASS | 0.8 to 8.2 | PASS |

TABLE 2-continued

| Container # | Fabric (68) | Coating (42, 43) | Stitching (430) | IEC 61340-4-4, 2nd Ed., Ignition Test | Drum Voltage (kV) | Drum Test |
|---|---|---|---|---|---|---|
| 19 | QC Warp | 2.4% GMS | Quasi-conductive | PASS | 1.6 to 8.3 | FAIL |
| 20 | QC Warp | 3% Component X | Quasi-conductive | PASS | 3.6 to 7.4 | PASS (L) FAIL (H) |
| 21 | QC Warp | 4% Component X | Quasi-conductive | PASS | 2.1 to 7.5 | PASS (L) FAIL (H) |
| 22 | QC Warp | 6% Component X | Quasi-conductive | PASS | 2.4 to 6.3 | PASS |
| 23 | QC Warp | 8.5% Component X | Quasi-conductive | PASS | 2.0 to 5.9 | PASS |
| 24 | QC Warp | 12.5% Component X | Quasi-conductive | PASS | 1.5 to 6.4 | PASS |
| 25 | QC Warp | 2.5% Component Y/ 2% Component Z | Quasi-conductive (hems folded outside) | PASS | 1.0 to 10.6 | FAIL (L) PASS (H) |
| 26 | QC Warp | 2.5% Component Y/ 2% Component Z | Quasi-conductive (hems folded inside) | PASS | 1.7 to 12.3 | FAIL (L) PASS (H) |
| 27 | QC Warp | 5% Component Y/ 4% Component Z | Quasi-conductive (hems folded outside) | PASS | 1.5 to 7.1 | PASS (L & H) |
| 28 | QC Warp | 5% Component Y/ 4% Component Z | Quasi-conductive (hems folded inside) | PASS | 1.2 to 8.1 | PASS (L & H) |

In the drum test column, "L" refers to low humidity and "H" refers to high humidity. Containers 20-24 were tested with the amount of Component X ranging from 3% to 12.5%. These containers passed both the Ignition Test and the Drum Test at low humidity. However, containers 20 and 21 failed at high humidity. Therefore, at high humidity, greater than 4% Component X of the total coating weight is preferred. Containers 25 and 26 passed both the Ignition Test and Drum Test at high humidity, but failed the Drum Test at low humidity. Container 25 had three ignitions at low humidity while container 26 had two ignitions. Thus, at low humidity, 5% Component Y of the total coating weight is preferred.

While the foregoing has described in detail preferred embodiments known at the time, it should be readily understood that the invention is not limited to the disclosed embodiments. Rather, the invention can be modified to incorporate any number of variations, alterations, substitutions or equivalent arrangements not heretofore described, but which are commensurate with the spirit and scope of the invention. For example, while the embodiments described herein relate to flexible fabric containers, there are other applications envisioned. Examples of other applications include use in pneumatic conveyor tubes or gravity slides or as liners in other containment vessels that transport products in situations where triboelectric charging may take place. Accordingly, the invention is not to be seen as limited by the foregoing description.

What is new and desired to be protected by Letters Patent of the United States is:

1. A controlled-conductive flexible fabric container with a reduced energy of electrostatic discharge for use in a combustible environment, comprising:

a woven fabric configured to form the controlled-conductive flexible fabric container that while grounded has sufficient charge dissipation within the container in order for the residual charge to be maintained below that required to cause potentials to be induced on nearby isolated conductors, said potentials sufficient to cause an incendiary discharge in the combustible environment, wherein the container has side walls, a top attached to the side walls, and a bottom attached to the side walls.

2. The controlled-conductive flexible fabric container according to claim 1, further comprising a plurality of loops attached to the side walls of the container.

3. The controlled-conductive flexible fabric container according to claim 1, further comprising edge webbing that is sewn to edges of the side walls, edges of the top, and edges of the bottom.

4. The controlled-conductive flexible fabric container according to claim 1, wherein said woven fabric includes a plurality of quasi-conductive fibers having corona discharge points, said fibers including one or more filaments, said filaments being sized and shaped to effect: corona discharge at said corona discharge points while having resistance to avoid incendiary discharge at ends of said filaments and along the lengths of said filaments at a rate that results in incendiary type discharges in the combustible environment.

5. The controlled-conductive flexible fabric container according to claim 1, wherein a surface of the container is coated with an additive having antistatic or static dissipative properties.

6. The controlled-conductive flexible fabric container according to claim 5, wherein the coating antistatic or static dissipative material additive includes glycerol monostearate, Component X, or Component Y.

7. The controlled-conductive flexible fabric container according to claim 6, wherein the Component Y comprises a composition including an electrostatic dissipative blend of 40 to 84 weight % of a polyamide polymer, greater than 15 and not more than 59 weight % of a potassium ionomer, and greater than 1 and not more than 10 weight % of one or more polyol.

8. The controlled-conductive flexible fabric container according to claim 6, wherein the coating antistatic or static dissipative material additive includes from 4% to 12.5% Component X.

9. The controlled-conductive flexible fabric container according to claim 3, wherein the coating antistatic or static dissipative material additive includes to 2.5% to 5% Component Y, which is mixed with a compatibilizer, wherein the compatibilizer is Component Z.

10. The controlled-conductive flexible fabric container according to claim 9, wherein Component Y is mixed with Component Z at a ratio of Component Y/Component Z between 5:1 to 1:2.

11. The controlled-conductive flexible fabric container according to claim 10, wherein the ratio of Component Y/Component Z is 2.5% Component Y/2% Component Z.

12. The controlled-conductive flexible fabric container according to claim 10, wherein the ratio of Component Y/Component Z is 5% Component Y/4% Component Z.

13. The controlled-conductive flexible fabric container according to claim 1, further comprising an input spout attached to the top of the container.

14. The controlled-conductive flexible fabric container according to claim 1, further comprising an output spout attached to the bottom of the container.

15. A method for reducing the energy of electrostatic discharge in a combustible environment using a controlled-conductive flexible fabric container, comprising the steps of:

providing a woven fabric configured to form the controlled-conductive flexible fabric container, wherein the container has side walls, a top attached to the side walls, and a bottom attached to the side walls; and including a coating with an anti-static agent on the fabric so that, while grounded, there is sufficient charge dissipation within the container in order for the residual charge to be maintained below that required to cause potentials to be induced on nearby isolated conductors, said potentials sufficient to cause an incendiary discharge in the combustible environment.

16. A method as in claim 15, further comprising a plurality of loops attached to the side walls of the container.

17. A method as in claim 15, further comprising edge webbing that is sewn to edges of the side walls, edges of the top, and edges of the bottom.

18. A method as in claim 15 wherein the container coating includes an antistatic or static dissipative material as an additive.

19. A method as in claim 18, wherein the coating antistatic or static dissipative material additive includes glycerol monostearate, Component X, or Component Y.

20. A method as in claim 19, wherein Component Y comprises a composition including an electrostatic dissipative blend of 40 to 84 weight % of a polyamide polymer, greater than 15 and not more than 59 weight % of a potassium ionomer, and greater than 1 and not more than 10 weight % of one or more polyol.

21. A method as in claim 19, wherein the coating antistatic or static dissipative material additive includes from 4% to 12.5% Component X.

22. A method as in claim 19, wherein the coating antistatic or static dissipative material additive includes to 2.5% to 5% Component Y, which is mixed with a compatibilizer, wherein the compatibilizer is Component Z.

23. A method claim as in claim 22, wherein Component Y is mixed with Component Z at a ratio of Component Y/Component Z between 5:1 to 1:2.

24. A method claim as in claim 23, wherein the ratio of Component Y/Component Z is 2.5% Component Y/2% Component Z.

25. A method claim as in claim 23, wherein the ratio of Component Y/Component Z is 5% Component Y/4% Component Z.

26. A method as in claim 15, further comprising an input spout attached to the top of the container.

27. A method as in claim 26, further comprising an output spout attached to the bottom of the container.

28. A method as in claim 27 including the step of the container, while grounded, being emptied through the output spout or filled through the input spout with highly charged products.

29. A system with a reduced energy of electrostatic discharge for use in a combustible environment, the system comprising:

a controlled-conductive flexible fabric container formed from a woven fabric, wherein the woven fabric is configured such that the container while grounded has sufficient charge dissipation within the container in order for the residual charge to be maintained below that required to cause potentials to be induced on nearby isolated conductors, said potentials sufficient to cause an incendiary discharge in the combustible environment, and wherein the container has side walls, a top attached to the side walls, and a bottom attached to the side walls; and a hoisting apparatus.

30. The system according to claim 29, further comprising a plurality of loops attached to the side walls of the container.

31. The system according to claim 29, further comprising edge webbing that is sewn to edges of the side walls, edges of the top, and edges of the bottom.

32. The system according to claim 29, wherein the woven fabric includes a plurality of quasi-conductive fibers having corona discharge points, said fibers including one or more filaments, said filaments being sized and shaped to effect: corona discharge at said corona discharge points while having resistance to avoid incendiary discharge at ends of said filaments and along the lengths of said filaments at a rate that results in incendiary type discharges in the combustible environment.

33. The system according to claim 29, wherein the hoisting apparatus is a forklift having a fork.

34. The system according to claim 29, wherein the hoisting apparatus is a grounded apparatus.

35. The system according to claim 29, wherein a surface of the container is coated with an additive having antistatic or static dissipative properties.

36. The system according to claim 35, wherein the coating antistatic or static dissipative material additive includes glycerol monostearate, Component X, or Component Y.

37. The system according to claim 36, wherein the Component Y comprises a composition including an electrostatic dissipative blend of 40 to 84 weight % of a polyamide polymer, greater than 15 and not more than 59 weight % of a potassium ionomer, and greater than 1 and not more than 10 weight % of one or more polyol.

38. The system according to claim 36, wherein the coating antistatic or static dissipative material additive includes from 4% to 12.5% Component X.

39. The system according to claim 36, wherein the coating antistatic or static dissipative material additive includes to 2.5% to 5% Component Y, which is mixed with a compatibilizer, wherein the compatibilizer is Component Z.

40. The system according to claim 39, wherein Component Y is mixed with Component Z at a ratio of Component Y/Component Z between 5:1 to 1:2.

41. The system according to claim 40, wherein the ratio of Component Y/Component Z is 2.5% Component Y/2% Component Z.

42. The system according to claim 40, wherein the ratio of Component Y/Component Z is 5% Component Y/4% Component Z.

43. The system according to claim 29, further comprising an input spout attached to the top of the container.

44. The system according to claim 43, further comprising an output spout attached to the bottom of the container.

* * * * *